US010539150B2

(12) United States Patent
Ling et al.

(10) Patent No.: US 10,539,150 B2
(45) Date of Patent: Jan. 21, 2020

(54) CENTRIFUGAL FAN WITH DUAL OUTLETS IN THE SAME DIRECTION AND FAN FRAME THEREOF

(71) Applicant: DELTA ELECTRONICS, INC., Taoyuan (TW)

(72) Inventors: Wei-I Ling, Taoyuan (TW); Shih-Kang Hsiung, Taoyuan (TW); Meng-Yu Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 533 days.

(21) Appl. No.: 15/168,443

(22) Filed: May 31, 2016

(65) Prior Publication Data

US 2016/0369811 A1 Dec. 22, 2016

Related U.S. Application Data

(60) Provisional application No. 62/180,332, filed on Jun. 16, 2015.

(30) Foreign Application Priority Data

May 9, 2016 (CN) ..... 2016 1 0301053

(51) Int. Cl.
*F04D 29/42* (2006.01)
*F04D 29/44* (2006.01)
(Continued)

(52) U.S. Cl.
CPC ..... *F04D 29/4246* (2013.01); *F04D 29/282* (2013.01); *F04D 29/441* (2013.01); *F04D 29/582* (2013.01); *F04D 29/661* (2013.01)

(58) Field of Classification Search
CPC ... F04D 29/282; F04D 29/4246; F04D 29/441
See application file for complete search history.

(56) References Cited

U.S. PATENT DOCUMENTS 4,944,654 A * 7/1990 Chou ..... F04D 29/441 165/126
5,738,492 A * 4/1998 Stanko ..... F04D 29/422 415/211.1

(Continued)

FOREIGN PATENT DOCUMENTS

CN 102230480 A * 11/2011
CN 102478025 A * 5/2012
JP 04350400 A * 12/1992

*Primary Examiner* — Woody A Lee, Jr.
*Assistant Examiner* — Christopher R Legendre
(74) *Attorney, Agent, or Firm* — Muncy, Geissler, Olds & Lowe, P.C.

(57) ABSTRACT

A centrifugal fan with dual outlets in the same direction includes a fan frame, an impeller, and a motor. The fan frame includes an upper cover, a base plate and a first air deflector. The base plate and the upper cover are connected to form an accommodating space and an air outlet plane. The first air deflector is arranged near the air outlet plane and divides the air outlet plane into a first air outlet and a second air outlet. The impeller is disposed in the accommodating space. The impeller and the side wall of the fan frame form a flow channel therebetween. The motor is connected to the impeller and drives it to rotate. The first air deflector extends inward of the flow channel from the air outlet plane and the end of the first air deflector has a first guide portion, which is a slanted surface.

14 Claims, 7 Drawing Sheets

(51) Int. Cl.

| | |
|---|---|
| ***F04D 29/28*** | (2006.01) |
| ***F04D 29/58*** | (2006.01) |
| ***F04D 29/66*** | (2006.01) |

(56) References Cited

U.S. PATENT DOCUMENTS

| | | | | |
|---|---|---|---|---|
| 5,837,020 | A * | 11/1998 | Cartellone | B01D 46/24 55/459.3 |
| 6,643,129 | B2 * | 11/2003 | Fujiwara | G06F 1/203 165/104.33 |
| 7,255,532 | B2 * | 8/2007 | Zheng | F04D 17/04 415/183 |
| 7,802,617 | B2 * | 9/2010 | Hwang | G06F 1/20 165/122 |
| 8,534,998 | B2 * | 9/2013 | Liang | F04D 29/4246 415/182.1 |
| 2005/0163607 | A1 | 7/2005 | Wang et al. | |
| 2007/0160462 | A1 | 7/2007 | Tsang et al. | |
| 2010/0071875 | A1 * | 3/2010 | Hwang | F04D 29/422 165/80.3 |
| 2011/0250065 | A1 | 10/2011 | Liang et al. | |
| 2013/0101449 | A1 | 4/2013 | Dickinson et al. | |
| 2016/0369811 | A1 * | 12/2016 | Ling | F04D 29/282 |

* cited by examiner

CENTRIFUGAL FAN WITH DUAL OUTLETS IN THE SAME DIRECTION AND FAN FRAME THEREOF

CROSS REFERENCE TO RELATED APPLICATIONS

This application claims the priority benefits of U.S. provisional application Ser. No. 62/180,332, filed on Jun. 16, 2015 and under 35 U.S.C. § 119(a) on Patent Application No(s). 201610301053.6 filed in People's Republic of China on May 9, 2016. The entirety of the above-mentioned patent applications are hereby incorporated by references herein and made a part of specification.

BACKGROUND OF THE INVENTION

Field of Invention

The present invention relates to a heat-dissipating device and, in particular, to a centrifugal fan.

Related Art

As the progress of technology, the electronic devices (e.g. laptop computers) have been developed towards high efficiency, high speed and high frequency, so the calculation loadings of the internal components of the electronic device are sufficiently increased, which is accompanied with higher temperatures. If the heat of the electronic device is not dissipated effectively, the stability of the electronic device will be decreased. In some cases, the lifetime of the electronic device will be reduced. Accordingly, it is a general approach to install a fan inside the electronic device for dissipating the heat of the electronic device.

The centrifugal fan is one of the most popular heat-dissipating devices. In the centrifugal fan, the cold air enters the air inlet formed on the upper surface of the housing for performing the heat exchange of the electronic device, and then the heated air is outputted through the air outlet formed on the side surface of the fan so as to bring the heat away. During the operation of the centrifugal fan, the impeller rotates at a constant speed so as to cause a periodical pressure change. The pressure change can induce an airflow, which will impact the fan frame or the internal structure of the centrifugal fan, so that the noise is generated.

In order to enhance the efficiency of the electronic device, the air quantity of the fan must be increased. However, when the air quantity of the fan is increased, the impact intensity of the airflow and the fan frame of the internal structure will be also increased, which causes the lauder noise.

Therefore, it is an important subject to provide a centrifugal fan that can increase the air quantity and decrease the generation of noise.

SUMMARY OF THE INVENTION

In view of the foregoing, an objective of the present invention is to provide a centrifugal fan with dual air outlets in the same direction that can increase the air quantity and decrease the generation of noise.

To achieve the above objective, the present invention discloses a centrifugal fan with dual outlets in the same direction, which includes a fan frame, an impeller and a motor. The fan frame includes an upper cover, a base plate and a first air deflector. The base plate and the upper cover are connected to form an accommodating space and an air outlet plane. The first air deflector is arranged near the air outlet plane and divides the air outlet plane into a first air outlet and a second air outlet. The impeller is disposed in the accommodating space. The impeller and the side wall of the fan frame form a flow channel therebetween. The motor is connected the impeller and drives it to rotate. The first air deflector extends inward of the flow channel from the air outlet plane, and the end of the first air deflector has a first guide portion.

To achieve the above objective, the present invention also discloses a fan frame of a centrifugal fan with dual outlets in the same direction. The fan frame includes an upper cover, a base plate and a first air deflector. The base plate and the upper cover are connected to form an accommodating space and an air outlet plane. The accommodating space is used for accommodating an impeller, and the impeller and a side wall of the fan frame form a flow channel therebetween. The first air deflector is arranged near the air outlet plane and divides the air outlet plane into a first air outlet and a second air outlet. The first air deflector extends inward of the flow channel from the air outlet plane, and an end of the first air deflector extending into the flow channel has a first guide portion.

In one embodiment, the first air deflector is composed of multiple sections.

In one embodiment, the first guide portion is a slanted surface.

In one embodiment, the fan frame further includes a second air deflector disposed on a part of the side wall located adjacent to the second air outlet and away from the first air outlet.

In one embodiment, an end of the second air deflector disposed adjacent to the second air outlet has a second guide portion.

In one embodiment, an end surface of the second guide portion includes at least a straight line, at least a curved line or their combination.

In one embodiment, an included angle between a line from a rotation center of the impeller to the end of the first air deflector extending into the flow channel and a line from the rotation center of the impeller to the air outlet plane, which is perpendicular to the air outlet plane, is between 20° and 114.5°.

In one embodiment, an included angle between axial directions of the first guide portion and the impeller is between 20° and 50°.

In one embodiment, an end surface of the first guide portion includes at least a straight line, at least a curved line or their combination.

As mentioned above, the centrifugal fan with dual outlets in the same direction of the invention has a first air deflector extending inward of the flow channel. The length of the extending part of the first air deflector can be adjusted based on the requirements, so that the air quantities of the first air outlet and the second air outlet are adjusted accordingly. In addition, the end of the first air deflector extending into the flow channel has a first guide portion. Accordingly, the centrifugal fan with dual outlets in the same direction is capable of adjusting the air quantities of two air outlets based on the requirements, so that the static pressure and air quantity of the centrifugal fan can be effectively increased for improving the heat-dissipating efficiency of the centrifugal fan and the noise can be reduced as the centrifugal fan is operating.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements. Moreover, the drawings of all implementation are schematic, and they do not mean the actual size and proportion.

The terms of direction recited in the disclosure, for example up, down, left, right, front, or rear, only define the directions according to the accompanying drawings for the convenience of explanation but not for limitation.

The names of elements and the wording recited in the disclosure all have ordinary meanings in the art unless otherwise stated. Therefore, a person skilled in the art can unambiguously understand their meanings.

Figure 1:
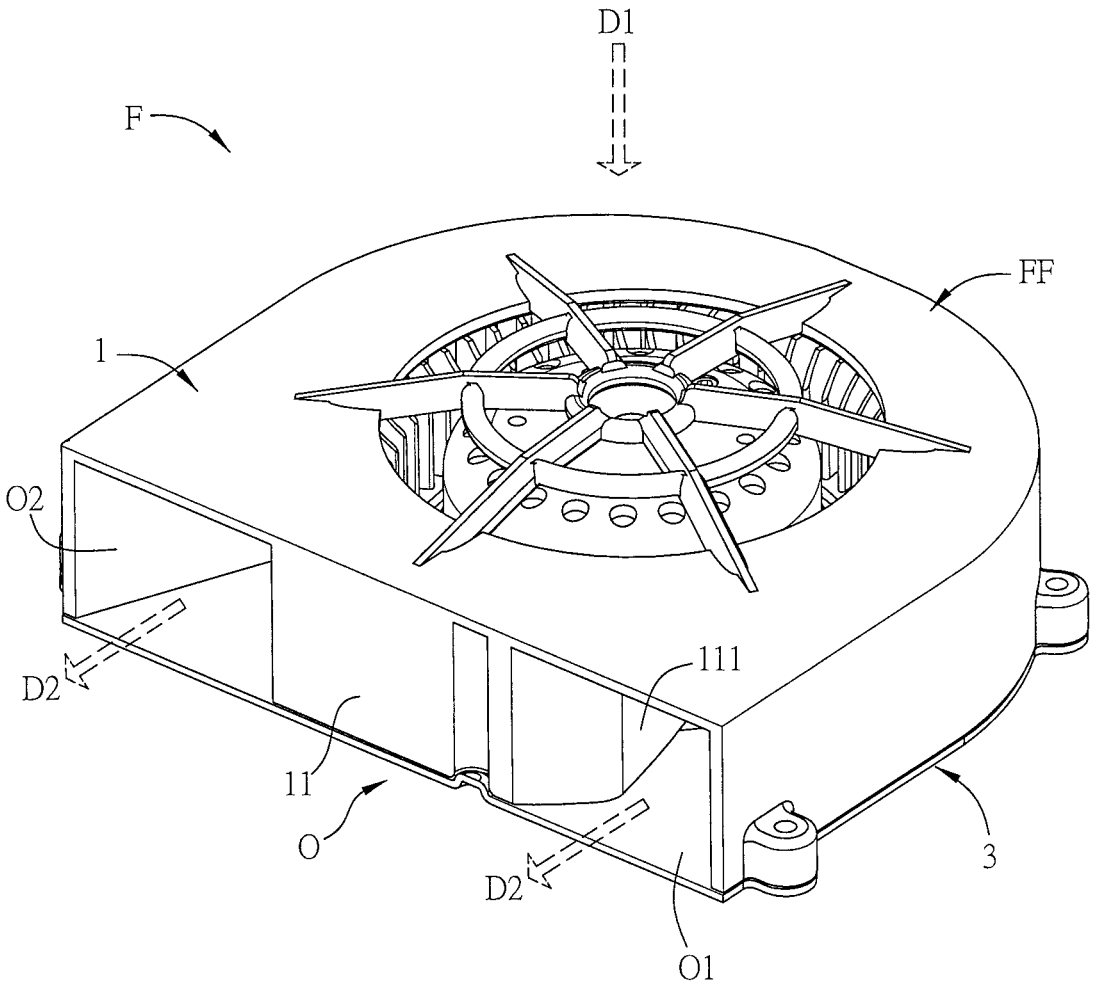
FIG. 1 is a schematic diagram showing a centrifugal fan with dual outlets in the same direction according to an embodiment of the invention.
Figure 2A:
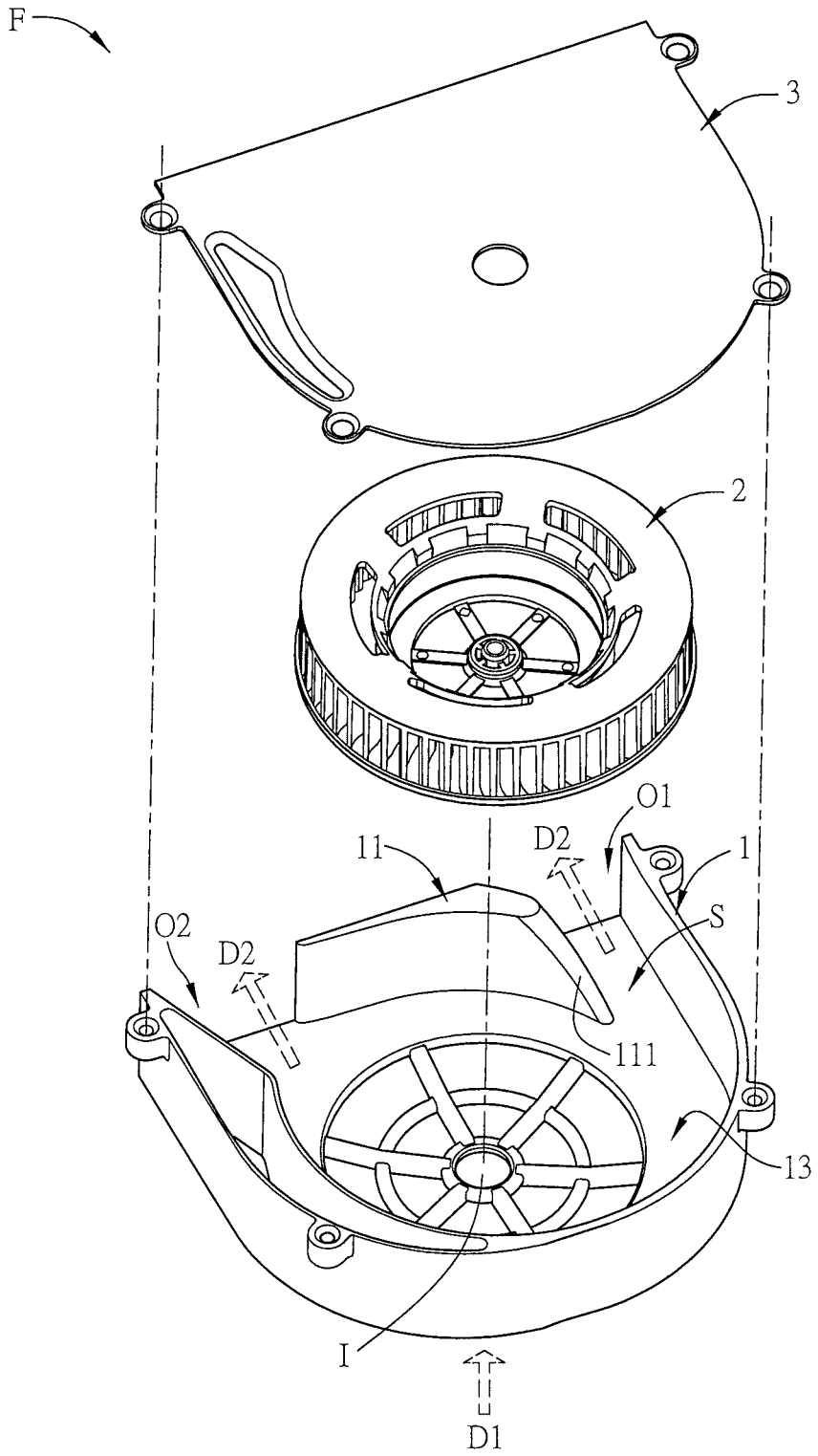
FIG. 2A is an exploded view of the centrifugal fan with dual outlets in the same direction according to the embodiment of the invention.

FIG. 1 is a schematic diagram showing a centrifugal fan F with dual outlets in the same direction according to an embodiment of the invention, and FIG. 2A is an exploded view of the centrifugal fan F of FIG. 1. Referring to FIGS. 1 and 2A, the centrifugal fan F includes a fan frame FF, which includes an upper cover 1 and a base plate 3. A first air deflector 11 including a first guide portion 111 is disposed on the upper cover 1. The first guide portion 111 is configured at one end of the first air deflector 11 extending inward of a flow channel 13. Two side surfaces of the first air deflector 11, one of which is close to the base plate 3 and the other of which is away from the base plate 3, have different lengths extending toward the flow channel 13. For example, one side surface of the first air deflector 11 close to the base plate 3 is shorter than the other side surface of the first air deflector 11 away from the base plate 3, so that a slanted surface on the first air deflector 11 is formed as a first guide portion 111. As shown in FIG. 1, the direction from the upper cover 1 to the base plate 3 is defined as an air inlet direction D1. An air outlet plane O is defined by the opening area surrounded by the upper cover 1 and the base plate 3 and the plane area of the first air deflector 11 disposed at the open end of the fan frame FF. An air outlet direction D2 is defined as a direction perpendicular to the air outlet plane O and away from the center of the centrifugal fan F. The first air deflector 11 divides the air outlet plane O into a first air outlet O1 and a second air outlet O2. The first air outlet O1 is located at one side of the first air deflector 11, which is the same as the first guide portion 111, and the second air outlet O2 is located at the opposite side of the first air deflector 11.

To be noted, the first air deflector 11 of this embodiment is disposed on the upper cover 1 and extending toward the base plate 3, but this invention is not limited thereto. In practice, the first air deflector 11 can be disposed on the base plate 3. Otherwise, the first air deflector 11, the upper cover 1 and the base plate 3 can be separately manufactured and then assembled by, for example but not limited to, wedging or screwing. Moreover, the first air deflector 11, the upper cover 1 and the base plate 3 can also be integrally formed as one piece. Besides, the first air deflector 11 can be designed with different lengths or have multiple sections according to the actual requirements. In addition, the first air deflector 11 includes a first guide portion 111 for decreasing the collision and friction of the airflow and the first air deflector 11. An end surface, i.e. the slanted surface of the first guide portion 111, includes at least a straight line, at least a curved line or their combination as shown in FIGS. 4 to 4D. In this embodiment, the end surface, i.e. the slanted surface of the first guide portion 111, includes a straight line, but this invention is not limited to this.

FIG. 2A is an exploded view of the centrifugal fan F with dual outlets in the same direction according to the embodiment of the invention. In order to clearly view the internal arrangement of the upper cover 1, the centrifugal fan F is flipped in a situation of the base plate 3 at the top and the upper cover 1 at the bottom. As shown in FIG. 2A, the centrifugal fan F includes an upper cover 1, an impeller 2, a base plate 3 and a motor for driving the impeller 2. The configuration of the motor is well known by those skilled persons, so it is not shown in FIG. 2A for making the figure simple and clear. The upper cover 1 and the base plate 3 are connected to form an accommodating space S, and the impeller 2 is disposed in the accommodating space S. The rotation center I of the impeller 2 is connected to the motor so that the motor can drive the impeller 2 to rotate. The impeller 2 and the side wall of the upper cover 1, i.e. the internal side wall, form a flow channel 13, as shown in FIG. 2B.

Figure 2B:
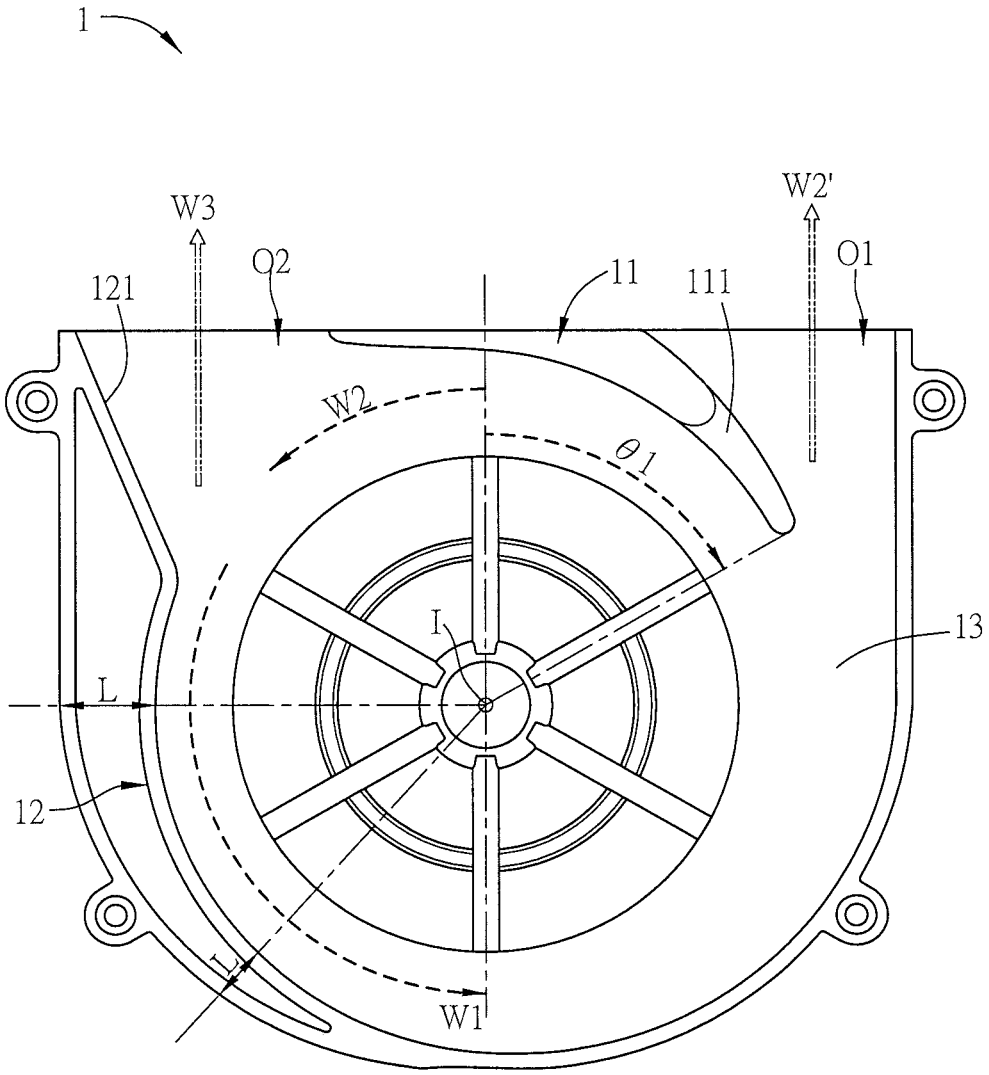
FIG. 2B is a schematic diagram showing an upper cover according to the embodiment of the invention.

FIG. 2B is a top view of the upper cover 1 according to the embodiment of the invention. Referring to FIGS. 2A and 2B, the upper cover 1 includes a first air deflector 11 and a second air deflector 12, and the second air deflector 12 is disposed on the side wall near the second air outlet O2 and away from the first air outlet O1. One end of the second air deflector 12 disposed adjacent to the second air outlet O2 has a second guide portion 121 for controlling and changing the airflow direction of the second air outlet O2. A width L is defined as a length of a straight line, which is passing through the rotation center I of the impeller, from the internal side wall of the fan F to the external side wall of the fan F. To be noted, the width L is not a constant value. In order to well understand the airflow direction in the fan F, a counterclockwise airflow close to the second air deflector 12 is defined as a first airflow W1. After flowing through the flow channel 13 and reaching the first guide portion 111, the first airflow W1 is divided into a first output airflow W2' and a second airflow W2 flowing counterclockwise inside the fan F. After reaching the second guide portion 121, the second airflow W2 is redirected to form a second output airflow W3. The second air deflector 12 has a section with various width L, which is extended into the flow channel 13. For example, in the flow area of the first airflow W1, the width L, excluding the second guide portion 121, close to the second air output O2 is larger, and the width L away from the second air output O2 is smaller. Accordingly, this design can provide a pressing effect to the first airflow W1 in the flow channel 13.

To be noted, the second air deflector 12 of this embodiment is disposed on the upper cover 1, but this invention is not limited thereto. In practice, the second air deflector 12 can be disposed on the base plate 3 based on the actual requirements. Otherwise, the second air deflector 12, the upper cover 1 and the base plate 3 can be separately manufactured and then assembled by, for example but not limited to, wedging or screwing. Moreover, the second air deflector 12, the upper cover 1 and the base plate 3 can also be integrally formed as one piece. Besides, the second air deflector 12 includes a second guide portion 121, which is configured to cooperate with the first air deflector 11. When there are two air output directions, the above configuration can adjust the air output direction of the second output airflow W3 flowing through the second air outlet O2. For example, the air output directions of the first output airflow W2' and the second output airflow W3 are in the direction D2. Of course, this invention is not limited to this. In another case, the first output airflow W2' and the second output airflow W3 can be in different directions, and their directions can be adjusted by the first air deflector 11 and the second guide portion 121. An end surface, i.e. the slanted surface of the second guide portion 121, includes at least a straight line, at least a curved line or their combination as shown in the viewing direction of FIG. 2A. In this embodiment, the end surface, i.e. the slanted surface of the second guide portion 121, includes a straight line, but this invention is not limited to this.

A line from the rotation center I of the impeller 2 to the air output plane O and perpendicular to the air output plane O and a line from the rotation center I of the impeller 2 of the impeller 2 to the end of the first air deflector 11 extending inward of the flow channel 13 have an included angle θ1. In this embodiment, the included angle θ1 is 70°.

Figure 3A:
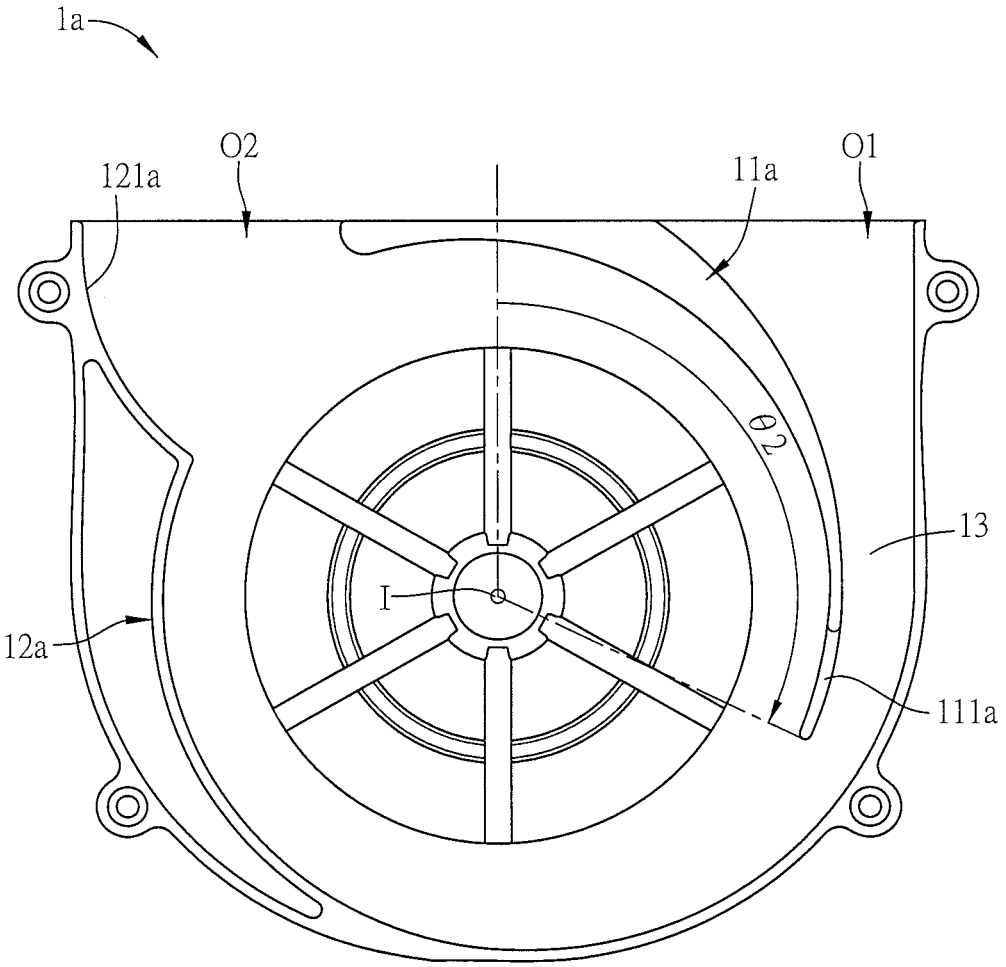
FIGS. 3A and 3B are schematic diagrams showing different aspects of the first air deflector of the upper cover as shown in FIG. 2B.

To adjust the ratio of the air quantities of the first air outlet O1 and the second air outlet O2, the length of the part of the first air deflector 11 extending inward of the flow channel 13 can be modified, and the corresponding included angle θ1 can be from 20° to 114.5°. FIG. 3A is a schematic diagram showing an aspect of the first air deflector of the upper cover 1*a*. As shown in FIG. 3A, the length of the part of the first air deflector 11*a* extending inward of the flow channel 13 is increased so as to decrease the air quantity of the first air outlet O1 and to increase the air quantity of the second air outlet O2. In this embodiment, the included angle θ2 can be 114.5°. In addition, the second guide portion may have different aspects for changing the airflow direction of the second air outlet O2. In this embodiment, the second guide portion 121*a* has a curved surface.

Figure 3B:
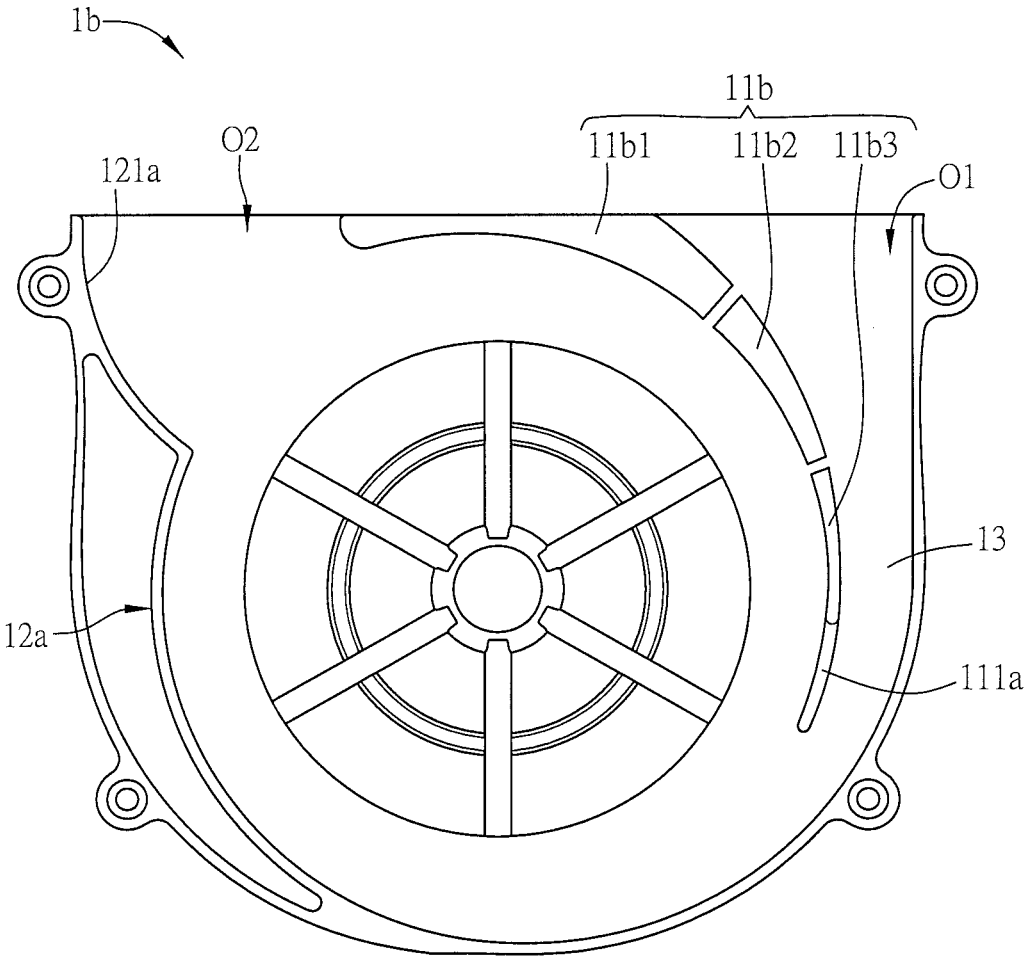

FIG. 3B is a schematic diagram showing another aspect of a first air deflector of an upper cover 11*b*. As shown in FIG. 3B, the first air deflector 11*b* is composed of multiple sections. For example, the first air deflector 11*b* of this embodiment includes a first deflector section 11*b*1, a second deflector section 11*b*2 and a third deflector section 11*b*3. To be noted, the first air deflector 11*b* of this embodiment is divided into three sections, including the first deflector section 11*b*1, the second deflector section 11*b*2 and the third deflector section 11*b*3, but this invention is not limited to this. In practice, the first air deflector 11*b* can be divided into multiple sections depending on the actual requirements or designs.

Figure 4A:
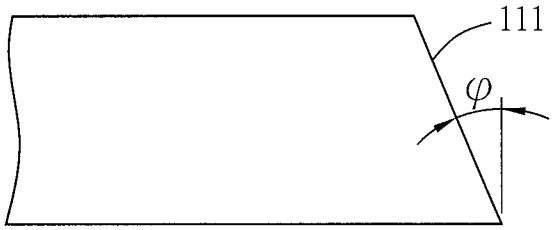
FIG. 4A is a schematic diagram showing a first guide portion according to the embodiment of the invention.

FIG. 4A is a schematic diagram showing the end surface, i.e. the slanted surface) of the first guide portion 111, viewing from the axial direction of the impeller 2. Referring to FIG. 4A, a slant angle φ is the included angle of the end surface of the first guide portion 111 and the axial direction of the impeller 2. The slant angle φ ranges from 20° to 50°, and is preferably about 30°. When the centrifugal fan F is in operation, the configuration of the slant angle φ can reduce the collision and friction of the airflow and the first air deflector 11, thereby decreasing the generated noise.

Figure 4B:
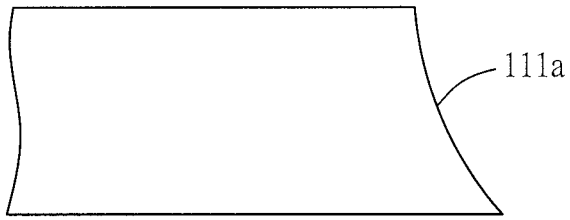
FIGS. 4B to 4D are schematic diagrams showing different aspects of the first guide portion according to the embodiment of the invention.
Figure 4C:
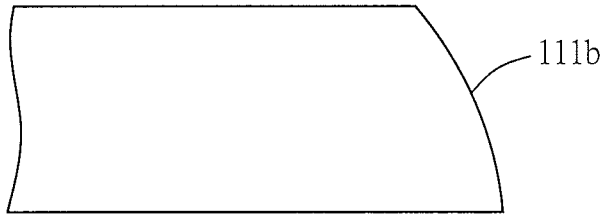
Figure 4D:
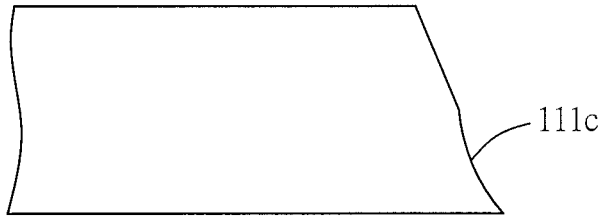

As shown in FIG. 4A, the end surface, i.e. the slanted surface of the first guide portion 111, is a straight line. However, the first guide portion may have different aspects as shown in FIGS. 4B to 4D. As shown in FIG. 4B, the first guide portion 111*a* has a concave curved surface. As shown in FIG. 4C, the first guide portion 111*b* has a convex curved surface. As shown in FIG. 4D, the first guide portion 111*c* is composed of at least a straight line and at least a curved line.

Figure 5:
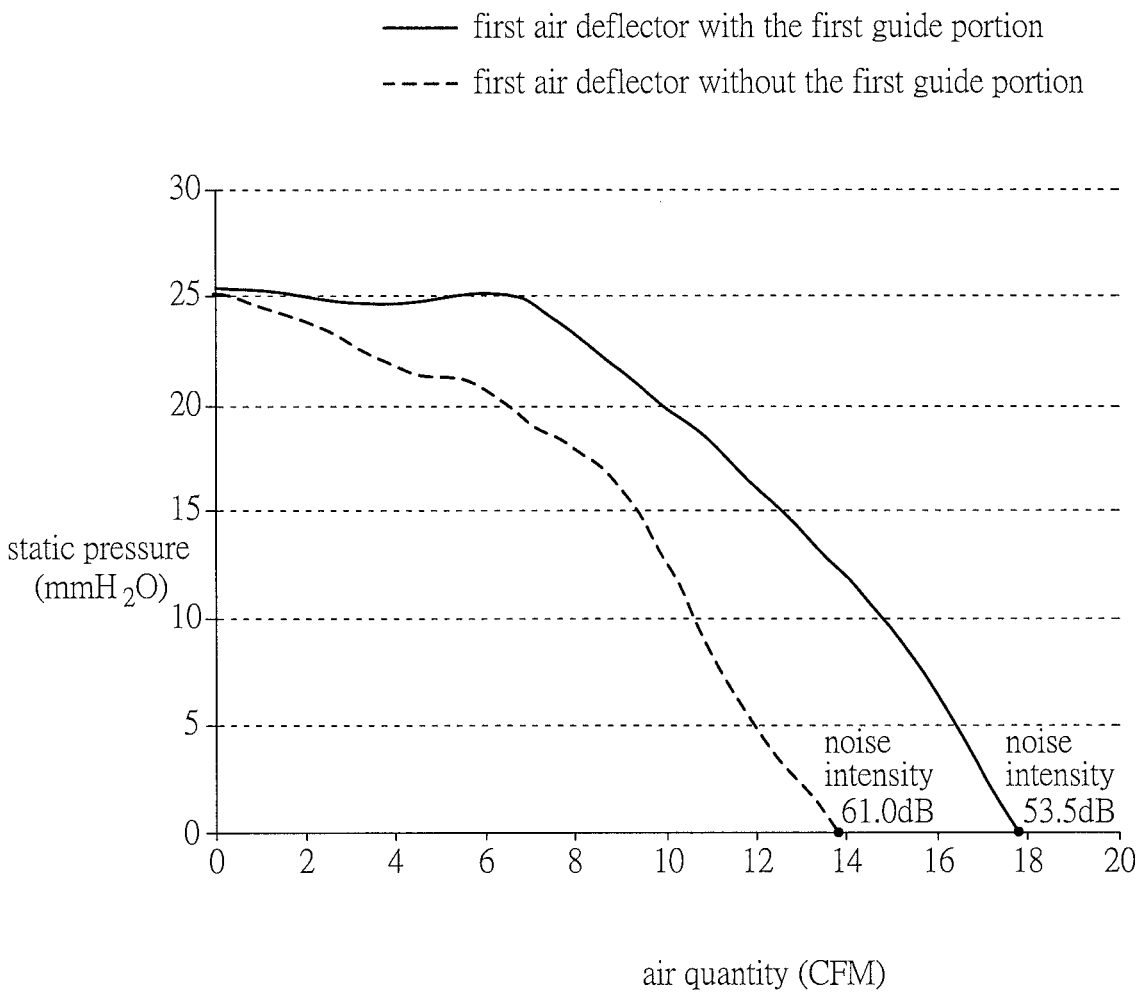
FIG. 5 is a schematic diagram showing the comparison of the test results as the first air deflectors are configured with and without the first guide portion.

FIG. 5 is a schematic diagram showing the comparison of the test results as the first air deflectors 11 are configured with and without the first guide portion 111. The end of the first air deflector 11 extending inward of the flow channel is a vertical side wall instead of the above slanted surface. With the same test parameters, the same size and rotation speed, the air quantity of the centrifugal fan configured with the slanted surface is larger than that of the centrifugal fan configured without the slanted surface, and the air quantity under the same static pressure or the static pressure under the same air quantity is increased by 20% to 30%. In the noise intensity test, the noise intensity of the centrifugal fan configured with the slanted surface is 53.5 dB, while the noise intensity of the centrifugal fan configured without the slanted surface is 61.0 dB. This result indicates that the first air deflector configured with the slanted surface can effectively improve the static pressure and air quantity of the centrifugal fan, thereby increasing the heat-dissipating efficiency of the centrifugal fan and decreasing the noise of the centrifugal fan.

In summary, the centrifugal fan with dual outlets in the same direction of the invention has a first air deflector extending inward of the flow channel. The length of the extending part of the first air deflector can be adjusted based on the requirements, so that the air quantities of the first air outlet and the second air outlet are adjusted accordingly. In addition, the end of the first air deflector extending into the flow channel has a first guide portion. Accordingly, the centrifugal fan with dual outlets in the same direction is capable of adjusting the air quantities of two air outlets based on the requirements, so that the static pressure and air quantity of the centrifugal fan can be effectively increased for improving the heat-dissipating efficiency of the centrifugal fan and the noise can be reduced as the centrifugal fan is operating.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A centrifugal fan with dual outlets in the same direction, comprising:

a fan frame comprising an upper cover, a base plate and a first air deflector, wherein the first air deflector is composed of multiple discrete segments, the base plate and the upper cover are connected to form an accommodating space and an air outlet plane, and the first air deflector is arranged near the air outlet plane and divides the air outlet plane into a first air outlet and a second air outlet;

an impeller disposed in the accommodating space, wherein the impeller and a side wall of the fan frame form a flow channel therebetween; and a motor connected to the impeller and driving it to rotate;

wherein the first air deflector extends inward of the flow channel from the air outlet plane, and an end of the first air deflector extending into the flow channel has a first guide portion, wherein an air inlet is opposite to the base plate, the first air deflector is between the air inlet and the base plate, one side surface of the first air deflector close to the air inlet is longer than another side surface of the first air deflector away from the air inlet, so that a slanted surface on the first air deflector is formed as the first guide portion.

2. The centrifugal fan of claim 1, wherein the slanted surface of the first guide portion comprises at least a straight line, at least a curved line or their combination.

3. The centrifugal fan of claim 1, wherein the fan frame further comprises a second air deflector disposed on a part of the side wall located adjacent to the second air outlet and away from the first air outlet.

4. The centrifugal fan of claim 3, wherein an end of the second air deflector disposed adjacent to the second air outlet has a second guide portion.

5. The centrifugal fan of claim 4, wherein an end surface of the second guide portion comprises at least a straight line, at least a curved line or their combination.

6. The centrifugal fan of claim 1, wherein an included angle between a line from a rotation center of the impeller to the end of the first air deflector extending into the flow channel and a line from the rotation center of the impeller to the air outlet plane, which is perpendicular to the air outlet plane, is between 20° and 114.5°.

7. The centrifugal fan of claim 1, wherein an included angle between the slanted surface of the first guide portion and an axial direction of the impeller is between 20° and 50°.

8. A fan frame of a centrifugal fan with dual outlets in the same direction, comprising:

an upper cover;

a base plate, wherein the base plate and the upper cover are connected to form an accommodating space and an air outlet plane, the accommodating space is used for accommodating an impeller, and the impeller and a side wall of the fan frame form a flow channel therebetween; and a first air deflector arranged near the air outlet plane, wherein the first air deflector is composed of multiple discrete segments, the first air deflector divides the air outlet plane into a first air outlet and a second air outlet;

wherein the first air deflector extends inward of the flow channel from the air outlet plane, and an end of the first air deflector extending into the flow channel has a first guide portion, wherein an air inlet is opposite to the base plate, the first air deflector is between the air inlet and the base plate, one side surface of the first air deflector close to the air inlet is longer than another side surface of the first air deflector away from the air inlet, so that a slanted surface on the first air deflector is formed as the first guide portion.

9. The fan frame of claim 8, wherein the slanted surface of the first guide portion comprises at least a straight line, at least a curved line or their combination.

10. The fan frame of claim 8, further comprising:

a second air deflector disposed on a part of the side wall located adjacent to the second air outlet and away from the first air outlet.

11. The fan frame of claim 10, wherein an end of the second air deflector disposed adjacent to the second air outlet has a second guide portion.

12. The fan frame of claim 11, wherein an end surface of the second guide portion comprises at least a straight line, at least a curved line or their combination.

13. The fan frame of claim 8, wherein an included angle between a line from a rotation center of the impeller to the end of the first air deflector extending into the flow channel and a line from the rotation center of the impeller to the air outlet plane, which is perpendicular to the air outlet plane, is between 20° and 114.5°.

14. The fan frame of claim 8, wherein an included angle between the slanted surface of the first guide portion and an axial direction of the impeller is between 20° and 50°.

* * * * *